United States Patent [19]

Liefer et al.

[11] Patent Number: 4,557,086

[45] Date of Patent: Dec. 10, 1985

[54] GRAIN BIN FLOOR SUPPORT SYSTEM

[75] Inventors: Allen C. Liefer, R.R. 3. Box 362, Macon, Mo. 63552; Gilbert L. Loewen; Paul J. Magathan, both of Peabody, Kans.

[73] Assignee: Allen C. Liefer, Peabody, Kans.

[21] Appl. No.: 471,860

[22] Filed: Mar. 3, 1983

[51] Int. Cl.[4] ..... E04H 7/00; E04B 5/00

[52] U.S. Cl. ..... 52/194; 52/263; 52/478; 52/588; 52/302

[58] Field of Search ..... 52/192, 194, 245, 263, 52/478, 480, 588, 457, 222, 246, 247, 723, 302, 303, 304, 305, 667, 668, 669, 677, 684, 689

[56] References Cited

U.S. PATENT DOCUMENTS

| | | | |
|---|---|---|---|
| Re. 31,368 | 9/1983 | Trumper | 52/588 |
| 1,063,663 | 6/1913 | Davis | 52/686 |
| 1,570,814 | 1/1926 | Wolley | 52/687 |
| 1,649,577 | 11/1927 | Coryell | 52/696 |
| 1,673,360 | 6/1928 | Hauf | 52/684 |
| 1,863,257 | 6/1932 | Tashjan | 52/474 |
| 2,083,725 | 6/1937 | Manske | 52/489 |
| 2,439,853 | 4/1948 | Moffett | 52/23 |
| 2,565,292 | 8/1951 | Arthur | 52/69 |
| 2,818,009 | 12/1957 | Steffen | 52/219 |
| 2,901,960 | 9/1959 | Barre et al. | 52/198 |
| 3,067,843 | 12/1962 | Rushton et al. | 52/126.6 |
| 3,094,745 | 6/1963 | Stout | 52/506 |
| 3,233,297 | 2/1966 | Havener | 403/397 |
| 3,283,459 | 11/1966 | Beranek | 52/263 |
| 3,336,705 | 8/1967 | Vecchiarelli et al. | 52/222 |
| 3,426,445 | 2/1969 | Steffen | 52/192 |
| 3,520,101 | 7/1970 | Casto | 52/684 |
| 3,591,994 | 7/1971 | Steffen | 52/263 |
| 3,861,108 | 2/1975 | Hartman | 52/667 |
| 3,875,719 | 4/1975 | Menge | 52/669 |
| 4,064,671 | 12/1977 | Sauer | 52/669 |
| 4,073,110 | 2/1978 | Kennedy | 52/579 |

FOREIGN PATENT DOCUMENTS

| | | | |
|---|---|---|---|
| 6710469 | 10/1968 | Netherlands | 52/689 |

OTHER PUBLICATIONS

UK Patent Application GB 2085863, Compost Container, by Wulf Tempel, pub. 5/6/82.

Channel-Lok Floors, "Floor Support Systems" S & H Manufacturing (4 pages).

Bantams Super Floor, Bantam Systems, Chicago, IL, 2 pages, BSI 1-1-82.

Its in the Bin, KEHO, Keho Alta Products, Alberta, Canada.

Bulletin 601, 1/1/77, "Perforated-Corrugated Aeration Drying Floors", Caldwell Mnfg., Kearney, Nebraska.

*Primary Examiner*—John E. Murtagh

*Assistant Examiner*—Andrew Joseph Rudy

*Attorney, Agent, or Firm*—Neuman, Williams, Anderson & Olson

[57] ABSTRACT

A grain bin floor support system is disclosed that uses short posts, each formed by appropriately bending a piece of sheet metal into a V-shape such that the legs of the post diverge from one another and can be gripped and resiliently bent toward one another as by hand. Notches, which are cut into the top edge of the diverging legs of the post are aligned and of such a width that the outer channel of a floor panel can be gripped and accommodated in a binding fit in the two notches. A plurality of these posts are attached to the floor panel and a series of these panel and post assemblies forms a grain bin floor.

16 Claims, 12 Drawing Figures

FIG. 1
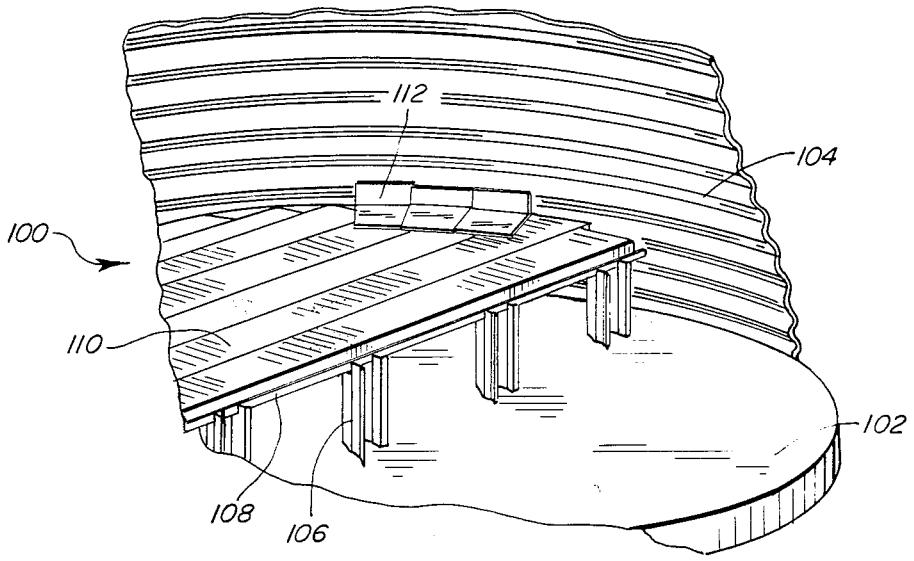
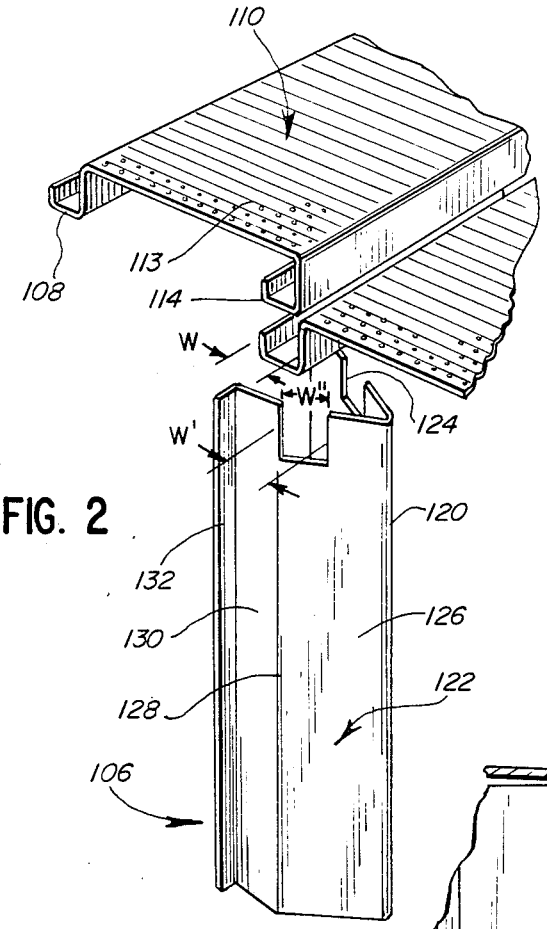
FIG. 2
FIG. 3
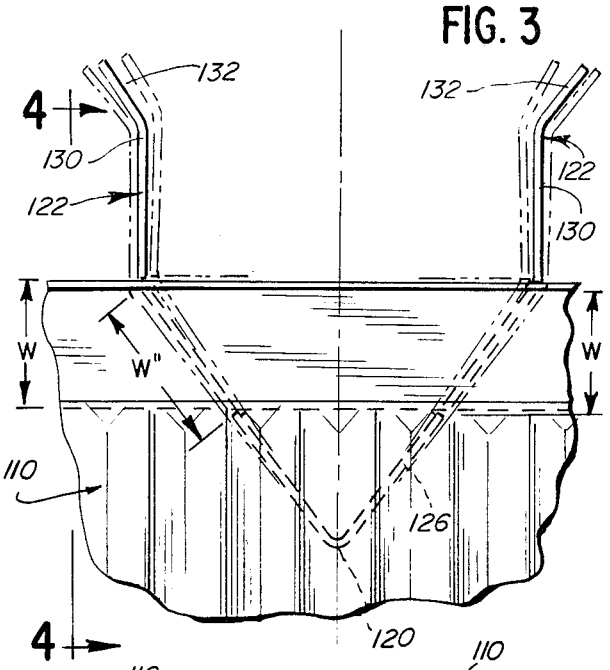
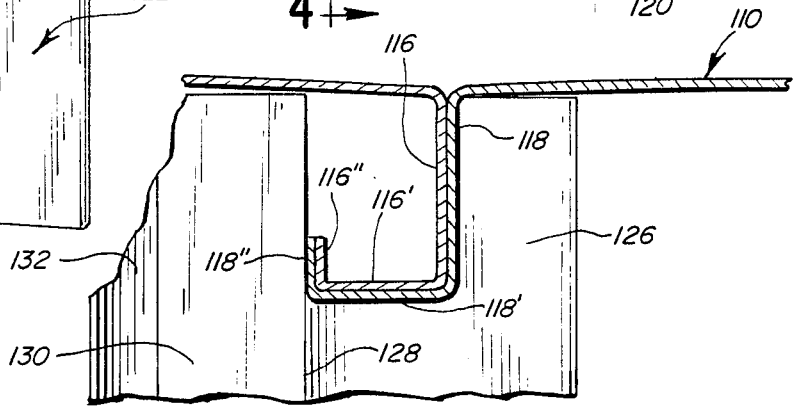
FIG. 4

FIG. 9
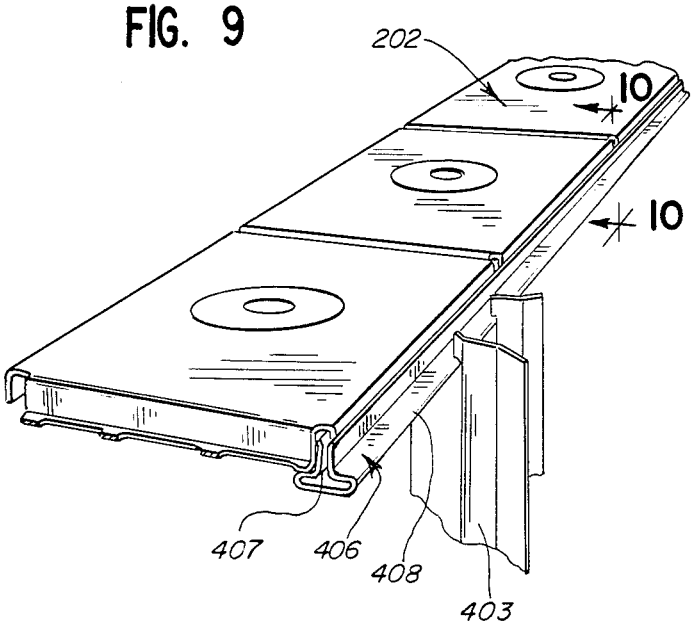
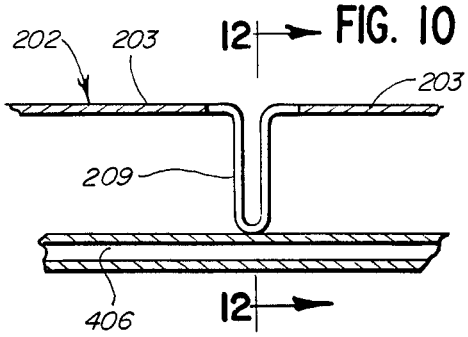
FIG. 10
FIG. 11
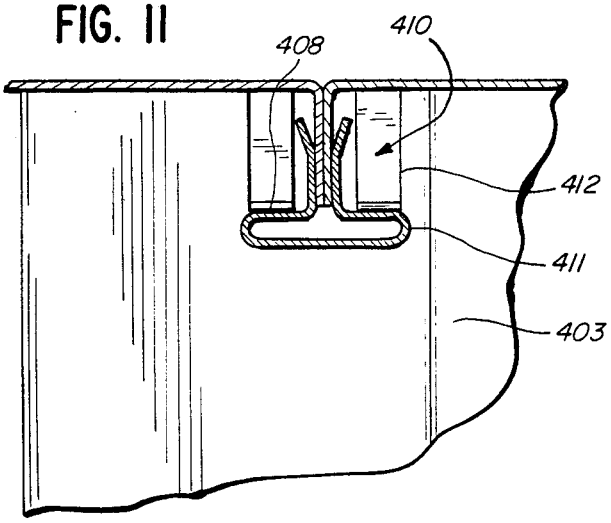
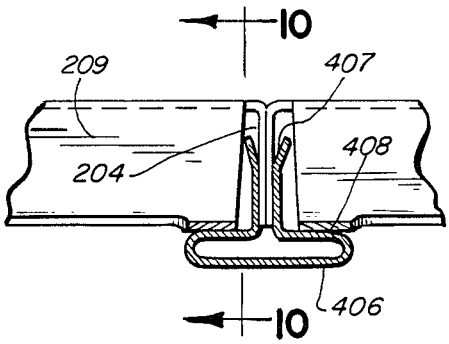
FIG. 12

GRAIN BIN FLOOR SUPPORT SYSTEM

BACKGROUND OF THE INVENTION

Field of the Invention

This invention relates generally to supports for floors in grain bins and the manner of assembling the floors in such bins.

It is an established practice to store small grains such as shelled corn, soybeans, rice and the like in a round metal bin having a false floor supported above the bse of the bin to form a plenum chamber across the bottom of the bin. The bin floor is usually perforated such that drying air may be forced into the plenum chamber and upward through the stored grain for drying and conditioning purposes. These bins may be of a substantial diameter, e.g., up to 50 feet or more. The false floors are often formed of sheet metal panels or "planks" which have integral depending interlockable channels at their edges. The channels of adjacent panel edges are internested to interlock the panels as the floor is installed and thereafter to form support beams extending longitudinally of the floor panels. Such floors also may be formed of separate beams and panels which rest upon or engage those beams. In floor systems of either type, spaced blocks, short posts or other direct support elements typically are distributed subjacent the beams, in the plenum chamber, for supporting the floor and the floor load on the base.

A variety of floor support designs have been developed for supporting false floors on the bases of bins. Many individual supports are necessary in a single bin due to the high loading stresses provided by a bin full of grain or the like.

It is highly desirable to provide bin floor assemblies which are flexible in design and easy to assemble and install while providing adequate support for the floor. Moreover, it is desirable to provide components and assemblies that can be fabricated economically using a minimum amount of material and easily stacked for compactness during transportation and storage. It is also desirable to provide an assembly design which insures that the supports will remain in their proper position beneath the floor during assembly and while the floor is not loaded. It is equally desirable for the supports to remain in their proper position during subsequent loading, unloading, cleaning, and inspecting, e.g. such that the floor can be walked on when the bin is empty without having supports tip or tilt and thereupon having to reset such floor supports before the bin. It is also desirable to provide a floor support design that will minimize resistance to air flow during the drying operation when drying air is being blown through the system.

OJBECTS OF THE INVENTION

It is an object of this invention to provide improved floor support assemblies in grain bins, and particularly to provide improved floor supports which will satisfy the aforenoted requirements and meet the particular needs for grain storage.

It is another object of this invention to provide floor supports which facilitate assembly of grain bin floor systems.

It is a further object of this invention to provide floor support systems that grip the floor channels or beams of grain bins and allow for shifting stresses and vibration of the floors while the bins are empty such that the floor supports remain in proper support relation with the floors.

Further and additional objects will appear from the following description, accompanying drawings and appended claims.

SUMMARY OF THE INVENTION

In accordance with the preferred embodiment of this invention for use with a conventional floor system, the aforementioned requirements and objects are satisfied through a grain bin floor support system that uses short posts each formed by appropriately bending a piece of sheet metal into a V-shape such that the legs of the post diverge from one another and can be gripped and resiliently bent further toward one another as by hand. Notches are cut into the portions forming the top edges of the spaced side walls of the post and are aligned and of a width such that the outer channel of a conventional floor panel can be gripped and accommodated in a binding fit in the two notches. The projected width of the notches, i.e., as mseasured normal to a line passing through both notches, is lesser than the width of a channel to be engaged therein, while the actual width of each notch is greater than the width of the channel. The floor edge channel can therefore fit into the notches of the post when the legs of the post are squeezed and released. As a result, the channel is snugly held in place. Preferably, the depth of the notch is slightly less than that of the channel so that the bottom channel edge rests on the bottom of the notch. The grain bin floor can be assembled by successively placing each panel on a surface such as a saw horse with its channel side up and fitting the requisite number of posts onto the larger outer channel which is along one edge of the panel. The panel with posts attached can then be placed post-side down and the inner narrower channel along the other edge of the panel can be forced into the outer channel of a panel previously assembled and positioned in a similar manner.

In another embodiment of this invention, a V-shaped sheet metal post has notches cut into the spaced top edges to grip a support beam which is separate from the floor panels. A plurality of these posts grip the beam so that the beam is supported on the floor of the grain bin. A series of these supported rails accommodate the edges of modular floor panels to result in a grain bin false floor.

In yet another embodiment of this invention, the support for a beam and modular floor panel system has L-shaped notches to accommodate the corresponding edges of the beam.

DESCRIPTION OF THE DRAWINGS

For a more complete understanding of this invention, reference should now be made to the embodiments illustrated in greater detail in the accompanying drawings and described below by way of examples of the invention.

FIG. 1 is a partial perspective view of a false floor support system in a round bin embodying teachings of this invention;

FIG. 2 is an enlarged, partial, exploded view of a floor support post and floor panels of the assembly of FIG. 1;

FIG. 3 is a top view of an assembled support system with the floor panel channel fit into the notches of the floor support post, and prior to positioning of the next adjacent panel;

FIG. 4 is a section through the notches, e.g., as taken along line 4—4 of FIG. 3;

FIG. 9 is a partial perspective view of the preferred false floor support system using the modular floor panels of FIGS. 7 and 8;

FIG. 10 is a sectional view at the hem of the floor system in FIGS. 9 and 12, taken along lines 10—10 of FIGS. 9 and 12;

FIG. 11 is an elevational view of the preferred support system when using the modular floor support system of FIG. 9; and FIG. 12 is a sectional view of the modular floor system along the hem, taken along line 12—12 in FIG. 10.

Figure 5:
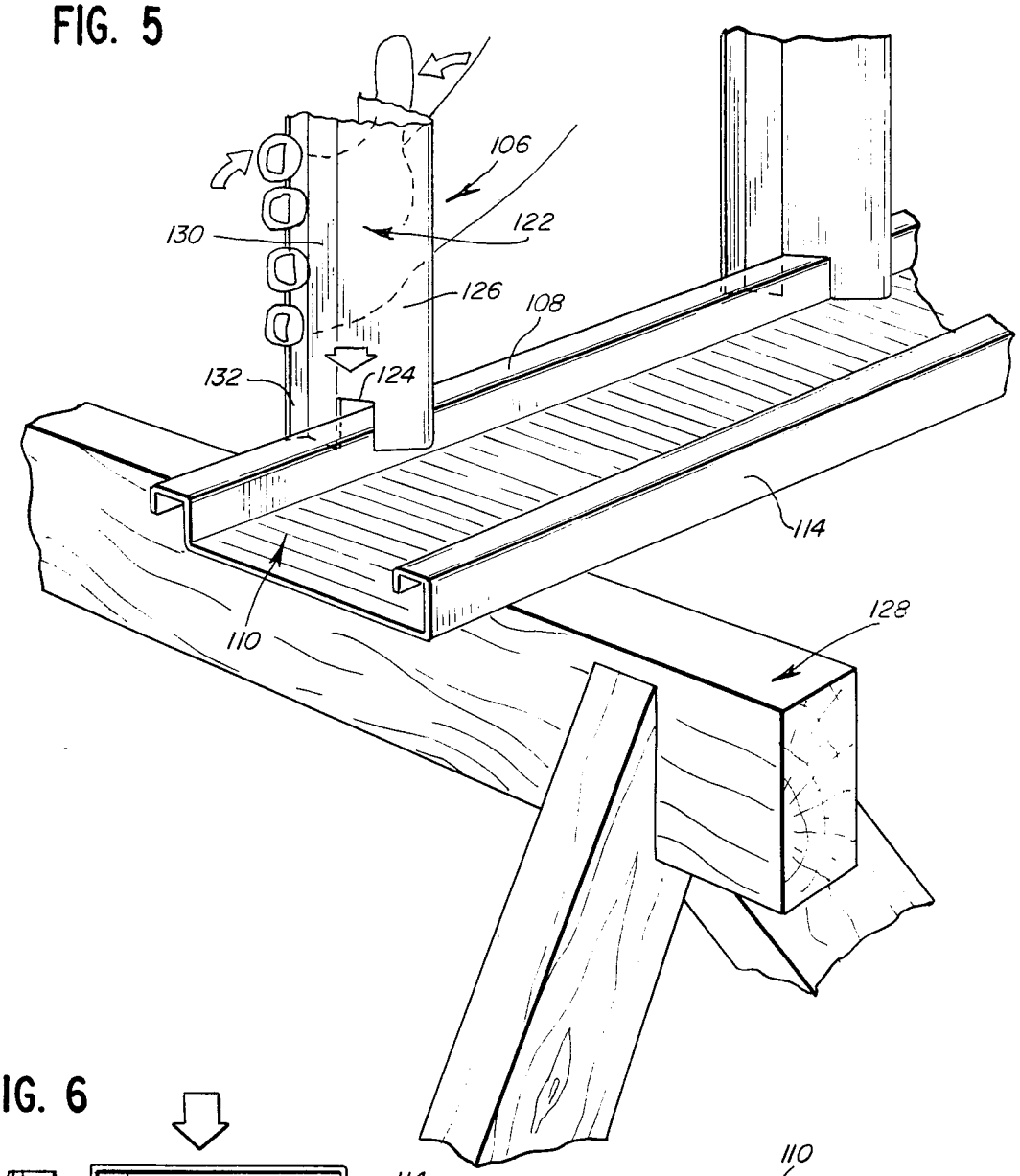
FIG. 5 is a partial perspective view of a floor support post being preassembled to a floor panel channel.

It should be understood that the drawings are not necessarily to scale and that an embodiment is sometimes illustrated in part by phantom lines and fragmentary views. In certain instances, details of the actual structure which are not necessary for the understanding of the present invention may have been omitted. It should be understood, of course, that the invention is not necessarily limited to the particular embodiments illustrated herein.

DETAILED DESCRIPTION

Turning first to FIG. 1 there is illustrated a perforate floor system 100 supported on the base 102 of a grain bin 104. The bin 104 may be of conventional round bin construction fabricated of corrugated steel panels. An air supply system (not shown), such as a fan with or without an auxiliary heat source, typically is provided to force air into the plenum between the false floor 100 and base 102. Such air is forced to flow upward through the perforate floor and through the grain for drying and conditioning purposes. The floor system 100 is comprised of multiple independent notched floor supports or posts 106 gripping the outer edge channels 108 of channel-shaped floor panels 110. The panels or planks 110 are interlocked or internested with one another along their edges. Several pieces of floor to wall flashing 112 are shown in place on top of the ends of the assembled panels 110 to close the floor-to-wall gaps. The specific floor channels 110 and their general manner of assembly with one another in a floor system 100 as well as the flashing 112 and the grain bin 104 are presented to illustrate a preferred embodiment of the invention for a conventional channel panel flooring system.

The configuration of panels 110 and the manner of their interfitting engagement with one another are known in grain bin constructions, and that part of the illustrated system sometimes is referred to as a "Channel-Lok" floor. Bin floors formed of such panels currently are in popular use. Referring for example to FIG. 2, each panel or plank 110 includes a central generally planar panel portion 113, an outwardly turned channel shaped flange 108 along one edge and an inwardly turned channel shaped flange 114 along the other edge. Thus the edge channels form the side or edge flanges of the overall channel-shaped cross-section of each panel. The panels 110 can be corrugated across portions 113 as indicated in FIG. 2, to provide transverse strength in a loaded bin. In addition, the panels 110 are perforated through portions 113 to allow the passage of air from the plenum into the storage part of the bin 104. Each panel typically is about eight inches wide overall, including the two edge channels 108, 114, and of various lengths to fit the various diameter bins. In a floor assembly, the panels 110 are laid up end to end in each run, with the end joints of adjacent runs being staggered. The final panel of each run is cut to length as necessary to accommodate the configuration of the bin. Each edge channel 108, 114 is about one inch wide and one and one-half inches deep, with the outer channel 108 being slightly larger than the inner channel 114 to permit close interfitting engagement of the panels along adjacent edges, see FIGS. 2 and 4, as successive panels are assembled into a complete floor. That is, as each panel is joined to the previously assembled units, the inwardly curved inner channel 114 along one edge is firmly seated within the exposed outwardly turned outer channel 108 of the last previously positioned run of panels. As will be seen, each of the channels 114, 108 is essentially J-shaped, including a depending leg 116, 118, a horizontal bight 116′, 118′ and a return lip or leg 116″, 118″. The interfitting channels form support beams or rails for support of the resulting floor.

It will be appreciated that a number of floor support posts 106 are used to support the joined or nested channel edges along each floor panel 110. The number of supports 106 necessary to support a panel 110 will vary with the length of the panel and the anticipated floor load, e.g., the depth of the bin. By way of example, the posts 106 may be provided at spacings of about one foot to about three feet depending upon the depth of grain for which the bin is designed.

The present invention is particularly directed to the floor supports 106 and their assembly with the floor panels 110.

Referring further to FIG. 2, which shows an exploded perspective view of a floor support post 106 and panels 110, as well as to FIG. 3, each post 106 is comprised of a unitary piece of sheet metal bent at a central bend 120 into a generally V-shape such that two diverging sides 122 result. A notch 124 is located along the top edge of a first divergent portion 126 of each side. Each side of the illustrated embodiment further includes an intermediate bend 128, a second portion 130, and a third or outwardly divergent tail portion 132. As best seen in FIG. 3, the portions 130 extend generally parallel to one another and to the bisecting axis of the post 106. The outer edge of each notch 124 furthest from the central bend 120 is along the intermediate bend 128, and the inner edge of the notch 124 is between the central bend 120 and the intermediate bend 128. The width of the notches 124 is such that the outer channel 108 of a floor panel 110 can be force fit into the notches and resiliently gripped by the notch edges. To this end, it will be observed that each notch 124 has an actual width W″ as measured along the divergent portion 126, and a projected width W′ as measured normal to a center line passing through both notches, where the actual width W″ is greater than the width W of the outer channel 108 but the projected width W' is slightly less than W and substantially less than the actual width W".

FIG. 3 illustrates that when the sides 122 of the post 106 are gripped and squeezed for resilient deflection inwardly toward one another, as shown by the two sets of phantom lines, the channel 108 can be fit into the notches 124 in the divergent sides 122 of the floor support 106. This is due to the slight increase in projected width W' as the included angle between the sides 122 is decreased. When the sides 122 are released, the post 106 springs back to an intermediate position, as shown by solid lines, where the effective width of the notch is equal to the actual width W of the outer channel 108 and the elastic resilience of the post insures that the channel will be gripped by the post at the notch edges. This provides retention of the posts on the panels during assembly as well as after assembly and when a bin is empty.

FIG. 2 shows a floor panel 110 with its inner channel 114 placed directly above the outer channel 108 of another floor panel 110 which has been fit into a floor support post 106. The width and depth of the inner channel 114 are slightly less than the width and depth of the outer channel 108 such that the adjacent panels 110 can be joined along a common edge as shown in FIGS. 1 and 4 with the central portions 113 of the panels essentially coplanar with one another.

Figure 6:
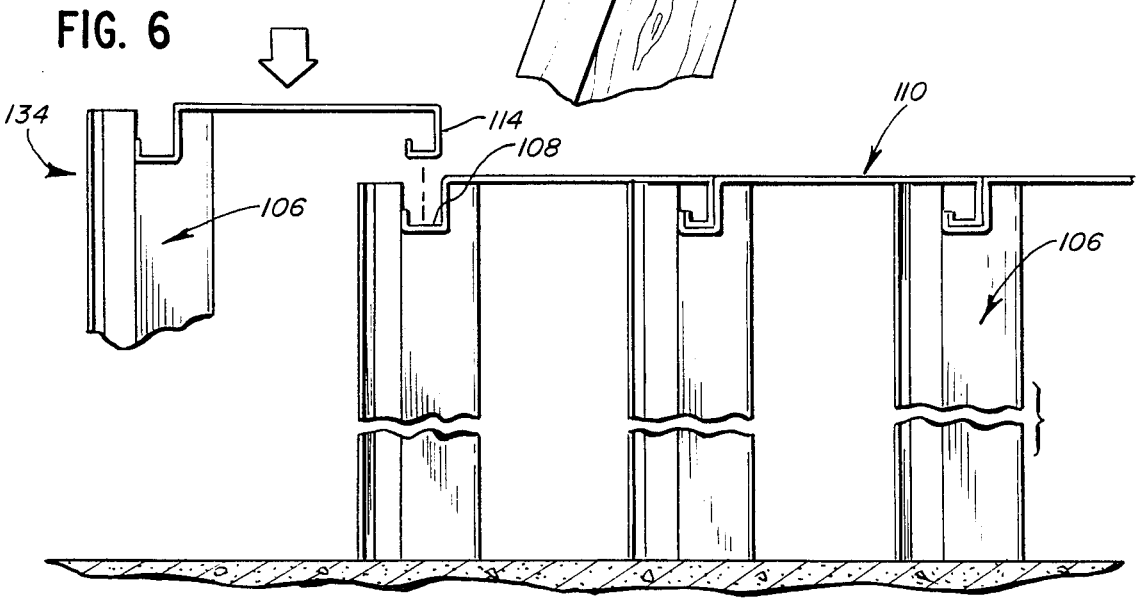
FIG. 6 is a front elevation of the panel piece and posts of FIG. 5 being placed in assembly with other floor supports and channels in a floor assembly.

FIGS. 5 and 6 further illustrate the preferred assembling of a floor support system employing this invention. In FIG. 5, a panel 110 is positioned channel side up on a saw horse 128. The sides 122 of each post 106 are gripped and squeezed, as by hand, at the tail portions 132. This squeezing action widens the effective width of the notches 124 so that the post 106 can be force fit with the outer channel 108. When the sides 122 are released, the outer channel 108 is resilently gripped by the notch edges to retain the posts in preassembly on the panels.

After all of the posts 106 have been attached to the outer channel 108 of the panel 110, the panel and posts preassembly 134 can be removed from the saw horse and turned channel side down for assembly into the floor system 100 with the posts remaining in place; see FIG. 6. The inner channel 114 can then be forced by foot or other means into the outer channel 108 of a preceding panel which is already in place in the floor. This process is repeated for adding successive floor panels and associated posts until the floor is completed.

Of course, the posts 106 also can be applied after the panels are in the floor position, as by engaging the posts onto each outer flange 108 after the respective panel is engaged with the preceding panel. However, this requires stooping and working beneath the floor plane by the erecting crewmen.

The notches 124 are slightly shallower in depth than the depth of the beams defined by flanges 108, 114 whereby the beams rest on the bottoms of the notches and there is a slight clearance between the top edges of the posts and the panel portions 113. This assures floor load transfer to the posts through the beams and avoids dimpling of the panel portions 113 by the posts.

The resulting floor support system satisfies the aforenoted needs. Each post 106 is centered on or vertically aligned with a single support beam onto which it is attached independently of any other portion of the assembly. The gripping action of the posts provide a self-adjusting mechanism by allowing the channels of the floor panels to maintain their position in the notch and withstand the shifting stresses and vibration of the floor while the bin is empty. Since each beam engages each post in the two spaced notches of that post, the application of floor loads provides a self-righting action to maintain or restore the post in an upright position in the event of any incipient tilting. The resilient gripping of the floor panel to the post enables the post and panel to remain attached and stable during loading and all other times. The simple open V-shape of the posts also enables stacking for storage and transportation.

Figure 7:
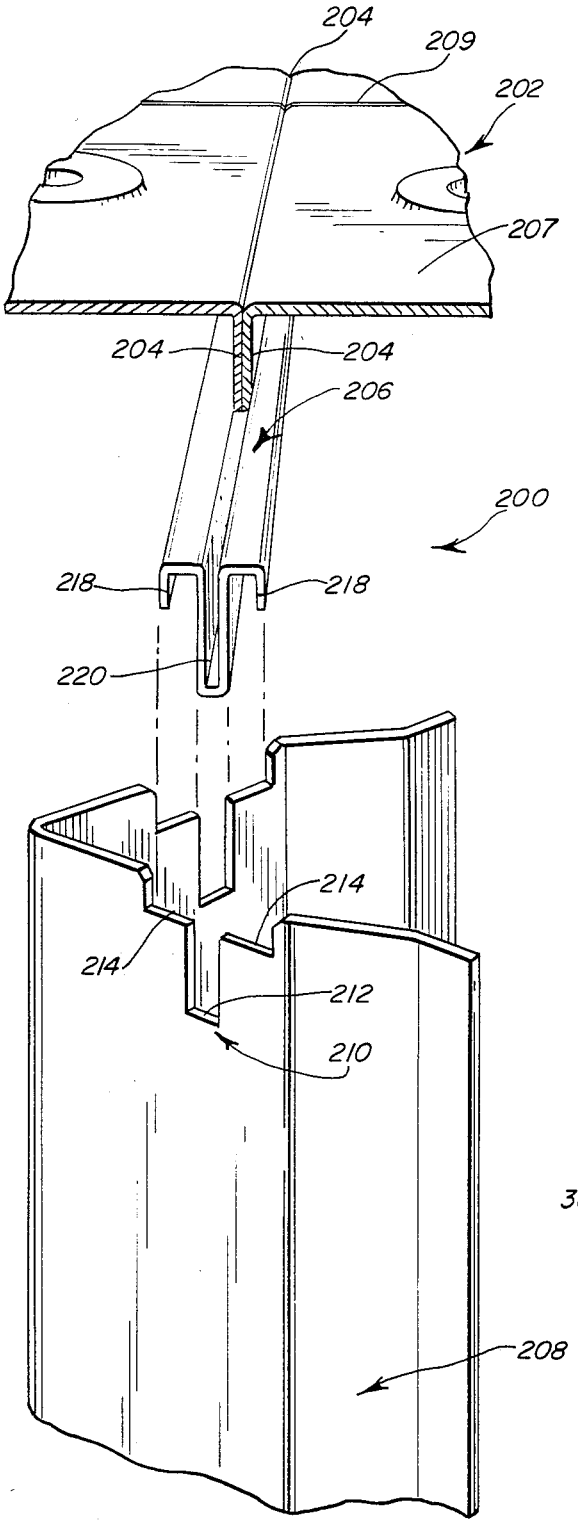
FIG. 7 is a partial exploded view of another embodiment of a support system in a false floor using independent beams or rails and modular floor panels, and also embodying teachings of this invention.

FIG. 7 shows a partial exploded view of a floor system 200 comprising floor panels 202 abutting together at their edges 204 and being held by separate elongated beams or rails 206 which are resiliently gripped by posts 208. The panels 202 can be of a simple channel design with each having a center panel portion 207 corresponding to portions 113 and simple planar lips or flanges 204 extending along the longitudinal edges 204 of the panel. A more preferable design employs modular floor panels as recently disclosed by Golden Grain Corporation of Clarence, Mo. These modular panels employ transverse hems 209 at unitary spacings along the panel so that panels of various lengths can be provided readily by breaking standard panels along appropriate selected hems. Lips or flanges 204 extend along the sides of the panels except at each hem where there is a break in each flange of the modular floor panel. Each post 208 which supports the floor 200 has notches 210 in the top edge of each diverging side comprising a central portion 212 and two adjacent outer portions 214. The depth of the central portion 212 is greater than the depth of the outer portions 214.

The notches 210 are designed to accommodate the rail or beam 206. The rail 206 defines two outer channels 218 and a central trough 220 where the depth of the trough 220 is greater than the depth of the outer channels 218. The outer channels 218 and the trough 220 of the beam 206 can be force fit into the notches 210 of the post 208 when the sides of the post 208 are resiliently flexed toward one another, as by squeezing. When the sides are released, the beam 206 is resiliently gripped by the post 208 in the same general manner as the post 106 of FIG. 1 grips the channel 108. Opposing flanges 204 of two adjacent floor panels 202 are simultaneously accommodated in the central trough 220.

The floor system 220 of FIG. 7 may be assembled by placing a rail or beam 216, trough side up, on a saw horse or other suitable support and attaching a predetermined number of posts 208 along its length. The post and beam assembly is then turned over so that the posts support the rail 206. The rail rests on the posts at the bottoms of the notches. A series of these post and rail assemblies can be placed in parallel relation to one another and at a spacing corresponding to the width of the panels 202. The opposing flanges 204 of the floor panels 202 can be placed in the trough 220 whereby the panels are supported by the post and rail assemblies.

Figure 8:
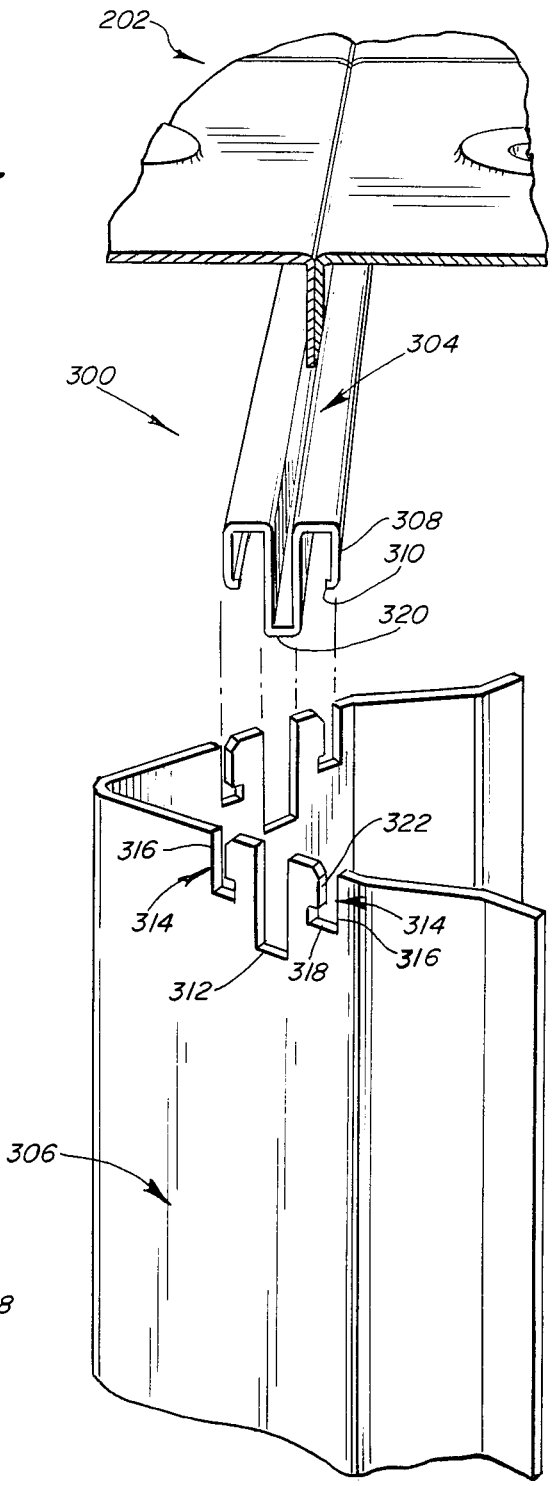
FIG. 8 is a partial exploded view of yet another embodiment of a false floor support system using modular floor panels and supports with L-shaped notches to provide additional gripping of the rails.

FIG. 8 shows a partial exploded view of a floor system 300 similar to that of FIG. 7 and with an additional interlocking feature. The floor system 300 comprises floor panels 202 and elongated rails or beams 304 gripped by the floor support posts 306 where each rail 304 has two L-shaped outer flange edges 308 in addition to a central trough portion 320. Each L-shaped outer edge has an inwardly extending tab or laterally extending latching protruberance 310. Each post 306 has a central notch 312 in the top edge of each side and two outer L-shaped notches 314 having vertical legs 316 and inwardly extending lower portions 318. The notches in the post 306 accommodate the central trough 320 and the outer edges 308 of the rail 304. The spacing between the tabs 310 of a rail 304 is slightly less than the spacing between the inner vertical edges 322 of notch portions 316. Thereby the flanges are flexed outward slightly during assembly and provide snap engagement of the tabs 310 in slot portions 318 when the rail and post are fully seated, in addition to the gripping of the sides of the notches on rail 304. Thus, this design provides additional support to the rail 304 and provides a locking action of the rail 304 to the posts 306 by accommodating the tabs 320 of the rail.

FIGS. 9 through 12 show views of the preferred floor support system 400 to be used with the modular floor panels 202 of FIGS. 7 and 8. FIG. 9 is a partial perspective view of the modular floor support system 400 and shows the side flange 204 of a section of a modular floor panel 202 in place with a rail or beam 406. The rail or beam 406 is supported and gripped by the post 403. The center embossment of the floor panel modules are shown in exaggerated relief. FIG. 10 is a sectional view at the hem 209 of the modular floor support system 400 through line 10—10 of FIGS. 9 and 12. FIG. 11 is a section across a rail and floor panels where a post 403 supports a rail 406. FIG. 12 shows a sectional view across the floor support system 400 at the hem 209 and through the line 12—12 of FIG. 10 of the modular floor panel 202. Each rail 406 is an elongated member generally similar to rails 206 and 304, but of a preferred cross section. It is of an inverted T-shape comprising a central open vertical trough 407 and laterally extending ledge 408 at its bottom portion. As seen particularly in FIG. 10, these ledges 408 support the ends of each of the transverse hems 209 which are located at unitary spacings along the length of each panel 202. The lips or flanges 204 extend along the sides of the panel 202 except at each hem 209 where there is a break or space between the flanges 204 of adjacent panel modules 203, see FIG. 10. FIG. 12 shows the lips 204 of two modular panels 202 abutting each other and fit into the central trough 407 of the rail 406, as occurs along the entire length of the rail 406 except at each hem 209 where there is the break in the flanges 204 as previously noted.

The support post 403 as shown in FIGS. 9 and 11 is of the same general cross section as the other posts described above and has notches 410 cut into the top diverging edges of the post sides. Each notch 410 has a lower gripping portion 411 and an entry or throat portion 412. The actual width of the entry portion 412 is narrower than the actual width of the lower portion 411 but is greater than the width of the rail ledge 408. The projected width of the entry portion 412 as measured normal to a center line passing through both notches 410 is less than the width of the ledge 408 but is sufficiently wide that when the sides of the post 403 are resiliently squeezed, the rail ledge 408 can be accommodated by the entry portion 412 of the notch. When the rail is placed in the lower gripping portion 411 of the notch 410 and the sides of the post 403 are released, the ledge 408 is resiliently gripped in the notch 410. In addition, since the entry portion 412 of the notch 410 is narrower in projected width, the rail 406 is locked into place by the resulting shoulders and prevented from being dislodged from the post 403.

It will be appreciated that the floor supports may be of a variety of specific cross-sectional shapes and dimensions.

Thus a grain bin floor support system and manner of assembly have been provided which meet the aforestated objects of this invention.

While certain embodiments of the invention have been shown, it will be understood, of course, that the invention is not limited thereto since modifications may be made and other embodiments of the principles of this invention will occur to those skilled in the art to which this invention pertains, particularly upon considering the foregoing teachings. It is, therefore, contemplated by the appended claims to cover any such modifications and other embodiments as incorporate those features which constitute the essential features of this invention within the true spirit and scope of the following claims.

What is claimed is:

1. An aeration flooring combination for storage bins comprising a plurality of perforated floor panels each having opposite side edges, said panels being disposed in side by side generally coplanar relationship with one another whereby the respective side edges of adjacent panels are adjacent to one another, a support beam having opposite sides and extending lengthwise of and subjacent each such pair of adjacent panel side edges, and a plurality of support posts each having diverging sides, a plurality of said support posts subtending each of said beams and being in generally vertical alignment therewith for vertical support of such beam above a subjacent base, and each of said posts being in gripping engagement by spring tension of said diverging sides with opposite sides of the respective beam.

2. A flooring combination as in claim 1 wherein said floor panels are of elongated rectangular configuration and said opposite side edges are generally parallel to one another.

3. A flooring combination as in claim 1 wherein said support beams are integral with said panels.

4. A flooring combination as in claim 3 wherein each of said panels is formed with an integral channel along each side edge, each of said channels being of a configuration to internest with a channel of the respective adjacent panel, and said posts being in such gripping engagement by spring tension with only the outer channel of the respective internested channels.

5. A flooring combination as in claim 1 wherein said support beams are separate components from said panels and the respective adjacent side edges of each adjacent pair of said panels engage in a common slot in one of said beams.

6. A flooring combination as in claim 5 wherein each of said beams defines an upwardly open channel extending longitudinally of said beam, each of said panels including a downwardly extending lip along each of said side edges, the respective lips of each adjacent pair of panels engaging in said channel of the respective beam.

7. A flooring combination as in claim 1 wherein each of said panels is formed with lateral configurations to provide enhanced beam strength across the width of the panel.

8. A flooring combination as in claim 1 wherein each of said panels is corrugated.

9. A flooring combination as in claim 1 wherein each of said panels has a plurality of ribs spaced along the length of the panel.

10. A flooring combination as in claim 1 wherein each of said posts with diverging sides is formed of sheet metal and is of a cross section providing a pair of portions extending in divergent relation to one another and resiliently bendable toward one another, said portions defining notches in the upper edges at the upper end of said post for receiving the respective beam, each of said notches including at least a portion for such gripping engagement with one of said corresponding beams and of a width such that the lateral projection thereof normally is slightly less than the width of the corresponding beam with which it is in gripping engagement, and said post being resiliently collapsible in cross section, for resilient clamping engagement by spring action of said post on said beam upon engagement of said beam in said notches.

11. A flooring combination as in claim 1, 2, 3, 4, 5, 6, 7, 8 or 9 wherein each of said posts with diverging sides is formed of sheet metal and is of a generally V-shape in cross section and is formed with opposed notches in the legs of said V-shape at the upper end of said post for receiving the respective beam, the lateral projection of at least a portion of said notches normally being of a width slightly less than the width of the respective beam with which it is in gripping engagement and said post being resiliently collapsible in cross section for resilient clamping engagement by spring action of said post on said corresponding beam upon engagement of said corresponding beam in said notches.

12. A flooring combination as in claim 1, 2, 5 or 6 wherein the upper ends of said posts and said beams are of configurations for effecting cooperative interlocking engagement therebetween.

13. A flooring combination as in claim 1, 2, 5 or 6 wherein each of said beams includes a depending central channel portion and at least one depending flange portion with a laterally extending latching protuberance spaced from said channel portion, the upper end of each of said posts formed with slots therein of spacings and configurations to receive said channel and flange portion of said beams in resilient snap-latch engagement.

14. A method of assembling a bin floor comprising positioning a floor panel having opposite side edges each with a flange therealong and with the flanges upward; attaching a plurality of posts having diverging sides to a respective flange with each of said posts in generally vertical alignment with the respective flange and said diverging sides in resilient gripping engagement by spring tension of said diverging sides with said respective flange to form a post and panel assembly; reorienting said post and panel assembly with said posts downward; and attaching said post and panel assembly in a bin floor assembly.

15. A method of assembling a bin floor having a plurality of support beams and support posts with diverging sides comprising successively assembling each of said support beams and a plurality of support posts with each of said posts in generally axial alignment with the respective beam and in resilient gripping engagement by spring tension of said diverging sides with said beam to form a post and beam assembly; orienting said post and beam assembly with said posts downward; and attaching said post and beam assembly in a bin floor assembly.

16. A flooring combination as in claim 11 wherein in each of said posts said notches are spaced from the central bend of said V-shape and said legs extend in generally parallel spaced relation to one another on the side of said notches opposite said central bend for convenient hand-squeezing of said legs toward one another to effect such resilient collapsing and application of the post to such beams.

* * * * *

UNITED STATES PATENT AND TRADEMARK OFFICE

CERTIFICATE OF CORRECTION

PATENT NO. : 4,557,086

DATED : December 10, 1985

INVENTOR(S) : ALLEN C. LIEFER, et al.

It is certified that error appears in the above-identified patent and that said Letters Patent is hereby corrected as shown below:

Column 1, line 12, "bse" should be --base--.

Column 1, line 15, "the" should be --this--.

Column 1, line 51, insert "reloading" before "the".

Signed and Sealed this

*First* Day of *April 1986*

[SEAL]

*Attest:*

DONALD J. QUIGG

*Attesting Officer*

*Commissioner of Patents and Trademarks*